US007726488B2

(12) United States Patent
Li

(10) Patent No.: US 7,726,488 B2
(45) Date of Patent: Jun. 1, 2010

(54) SHOCK ABSORBING DEVICE EMPLOYED IN PACKING

(75) Inventor: Ming Li, Guangdong (CN)

(73) Assignees: Premier Image Technology (China) Ltd., Foshan, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/171,260

(22) Filed: Jul. 10, 2008

(65) Prior Publication Data

US 2009/0139895 A1 Jun. 4, 2009

(30) Foreign Application Priority Data

Dec. 3, 2007 (CN) ..... 2007 1 0202823

(51) Int. Cl.
*B65D 81/02* (2006.01)
*B65D 85/30* (2006.01)

(52) U.S. Cl. ..... 206/586; 206/453; 206/320; 206/485

(58) Field of Classification Search ..... 206/590, 206/784, 592, 521, 586, 453, 320, 485
See application file for complete search history.

(56) References Cited

U.S. PATENT DOCUMENTS

| | | | | |
|---|---|---|---|---|
| 4,249,691 | A * | 2/1981 | Gardner | 229/120.26 |
| 5,341,934 | A * | 8/1994 | Hsu | 206/591 |
| 5,398,808 | A * | 3/1995 | Chen et al. | 206/320 |
| 5,772,025 | A * | 6/1998 | Chen et al. | 206/320 |
| 6,257,412 | B1 * | 7/2001 | Yamamoto et al. | 206/586 |
| 6,843,374 | B1 * | 1/2005 | Li et al. | 206/587 |

* cited by examiner

*Primary Examiner*—J. Gregory Pickett
(74) *Attorney, Agent, or Firm*—Zhigang Ma

(57) ABSTRACT

A shock absorbing device formed by a foldable card board sheet comprises a base portion, two wings extending perpendicularly from two opposite edges of the base portion, and two flaps extending perpendicularly from another two opposite edges of the base portion. The wings and the flaps are folded perpendicular to the base portion to enclose a space.

4 Claims, 7 Drawing Sheets

SHOCK ABSORBING DEVICE EMPLOYED IN PACKING

TECHNICAL FIELD

The present invention relates to shock absorption, and more particularly to a shock absorbing device protecting in the contents of a packing container.

BACKGROUND

Many objects, such as notebooks, DVDs etc. are generally shipped in packing containers. Shock absorbing devices in the packing container provide protection against damage caused by outside impact and motion during conveyance and handling. However, most shock absorbing devices are generally made of plastic or foam, which is costly.

Therefore, what is desired is a low-cost shock absorbing device.

SUMMARY

A shock absorbing device formed by a foldable card board sheet comprises a base portion, two wings extending perpendicularly from two opposite edges of the base portion, and two flaps extending perpendicularly from another two opposite edges of the base portion. The wings and the flaps are folded perpendicular to the base portion to enclose a space.

These and other advantages and novel features will be more readily apparent from the following detailed description set forth below taken in conjunction with the accompanying drawings.

DETAILED DESCRIPTION OF THE EMBODIMENTS

Figure 1:
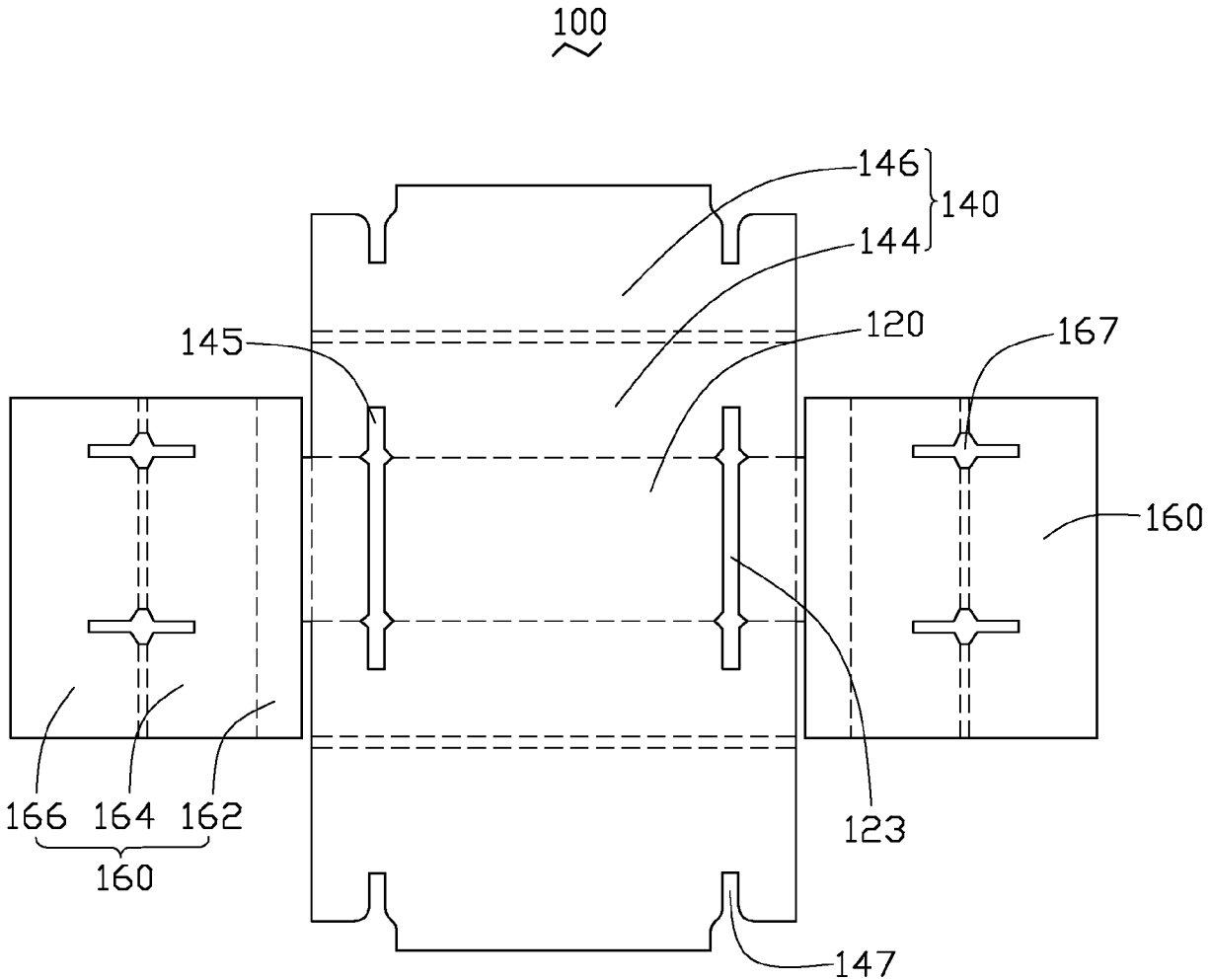
FIG. 1 is an expanded view of a shock absorbing device according to an exemplary embodiment.

In FIGS. 1-5, a shock absorbing device 100 according to an exemplary embodiment is illustrated. A foldable cardboard sheet cut as shown in FIG. 1 shows dashed lines where the shock absorbing device 100 is folded. The shock absorbing device 100 includes a rectangular base portion 120, two wings 140 extending perpendicularly from two opposite edges of the base portion 120, and two flaps 160 extending perpendicularly from another two opposite edges of the base portion 120. The base portion 120, the wings 140 and the flaps 160 enclose a space 180.

The base portion 120 defines two separated slots 123 therein.

Figure 2:
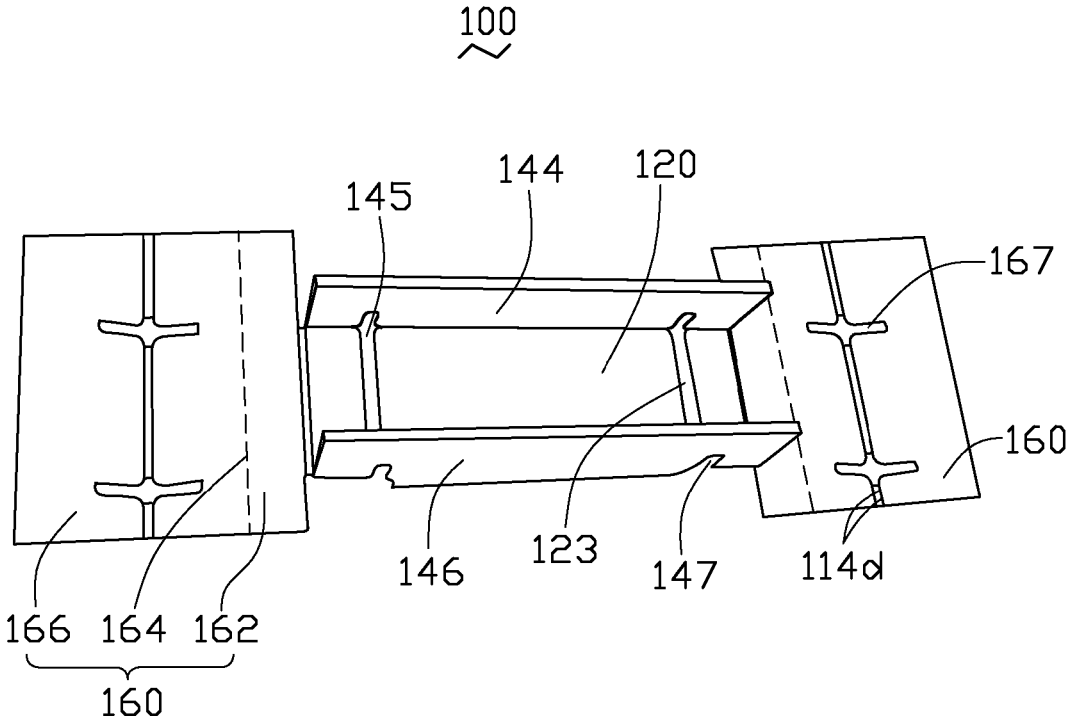
FIG. 2 is an isometric view of the shock absorbing device of FIG. 1 when partially folded.
Figure 3:
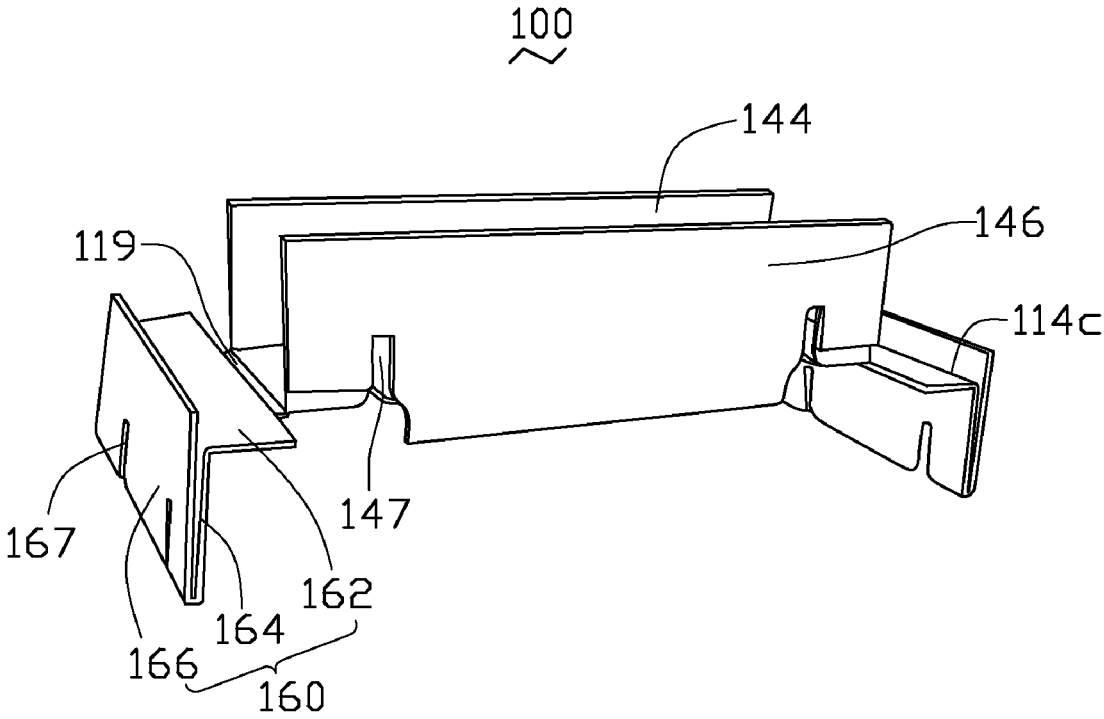
FIG. 3 is similar to FIG. 2, but shows the shock absorbing device further folded.
Figure 4:
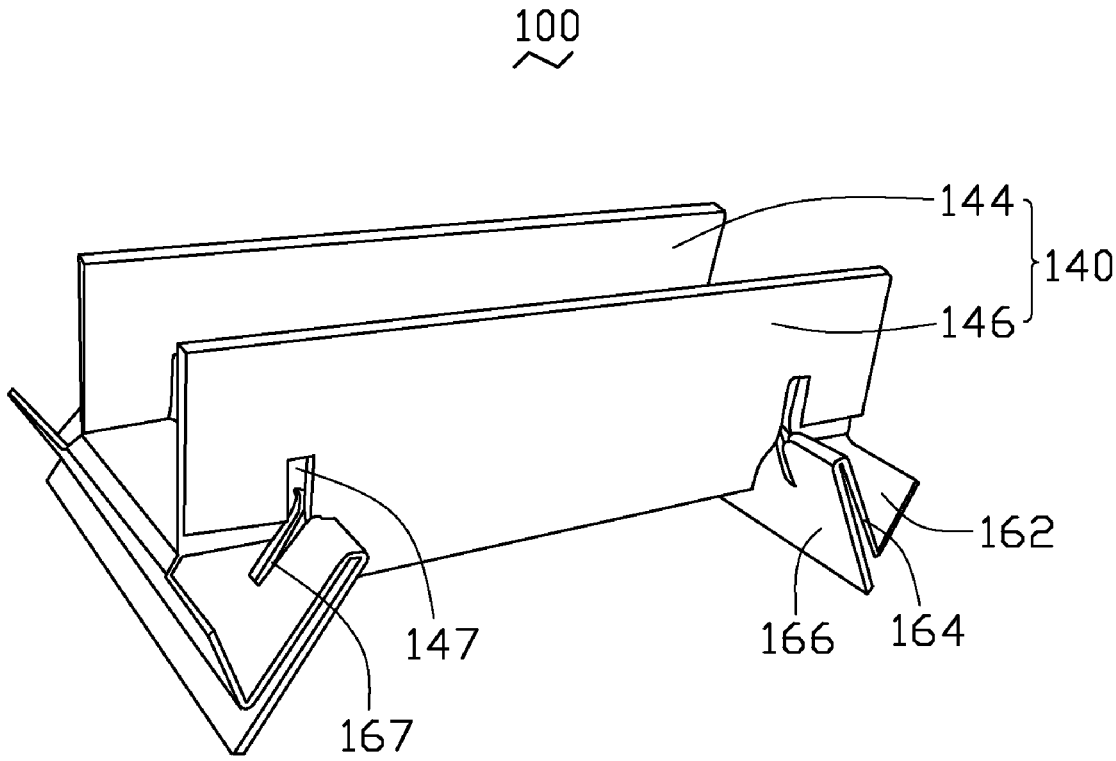
FIG. 4 is similar to FIG. 3, but shows the shock absorbing device mostly folded.
Figure 5:
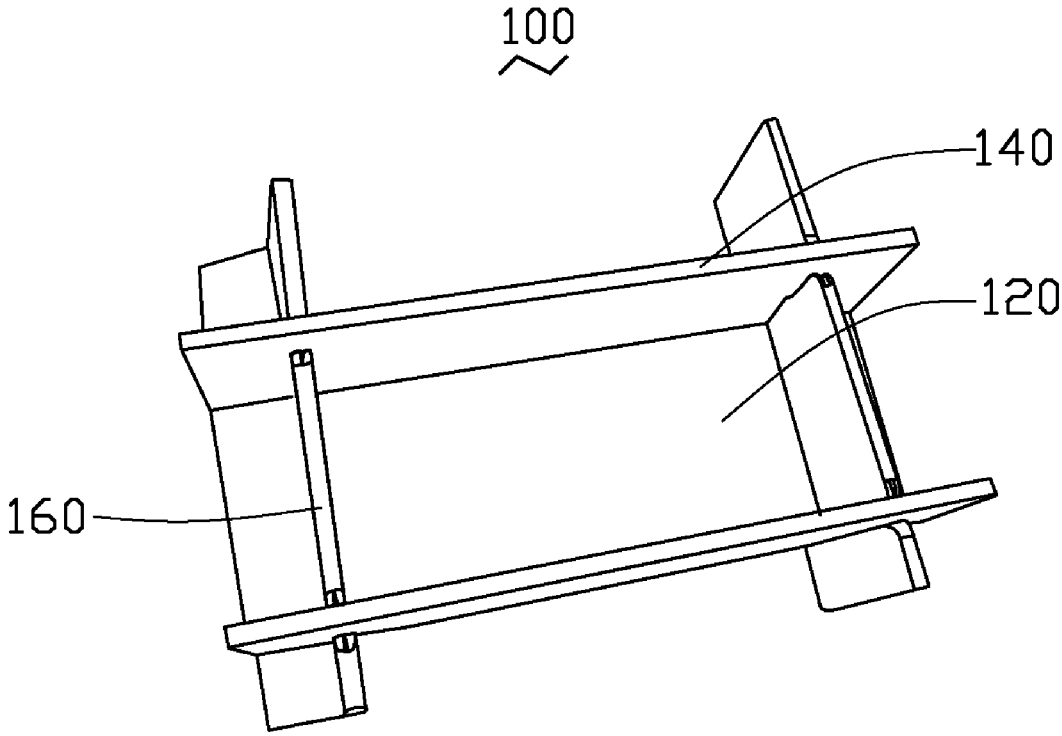
FIG. 5 is an isometric view of the shock absorbing device completely folded.

Each wing 140 includes a first sheet 144 extending perpendicularly from an edge of the base portion 120, and a second sheet 146 extending from the first sheet 144 and folded parallel to the first sheet 144. The first sheet 144 defines two grooves 145 therein, communicating with the slots of the base portion 120 respectively. As shown in FIGS. 2-4, the second sheet 146 defines two cutouts 147 aligned with the grooves 145 respectively, after the wing 140 has been folded.

Each flap 160 comprises a connecting flange 162 folded from the base portion 120, a first flange 164 extending from the connecting flange 162, and a second flange 166 extending from the first flange 164. Each flap 160 defines two spaced channels 167 therein, arranged perpendicular to and bisected by the corresponding junction of the first and second flanges 164, 166. As shown in FIGS. 3-4, the channels 167 in the second flange 166 are aligned with the channels 167 in the first flange 164, after the flap 160 has been folded.

During assembly, the first sheets 144 are folded perpendicular to the base portion 120. The second sheets 146 are folded parallel to the first sheets 144, to reinforce the first sheets 144. In the embodiment, the first sheets 144 face each other; while the second sheets 146 are disposed outside of the shock absorbing device 100. The cutouts 147 in the second sheets 146 are aligned with the grooves 145 in the first sheets 144. The first flanges 164 are folded perpendicular to the connecting flanges 162, respectively, with the second flanges 166 parallel thereto. The connecting flanges 162 are then folded, until the connecting flanges 162 reach a location parallel to the base portion 120. At this time, the first and second flanges 164, 166 of the flaps 160 are correspondingly inserted into the grooves 145 and the cutouts 147, with the wings 140 snapped in the channels 167 thereof. As a result, the flaps 160 interlocked with the wings 140 to form the shock absorbing device 100, particularly shown in FIG. 5.

Figure 6:
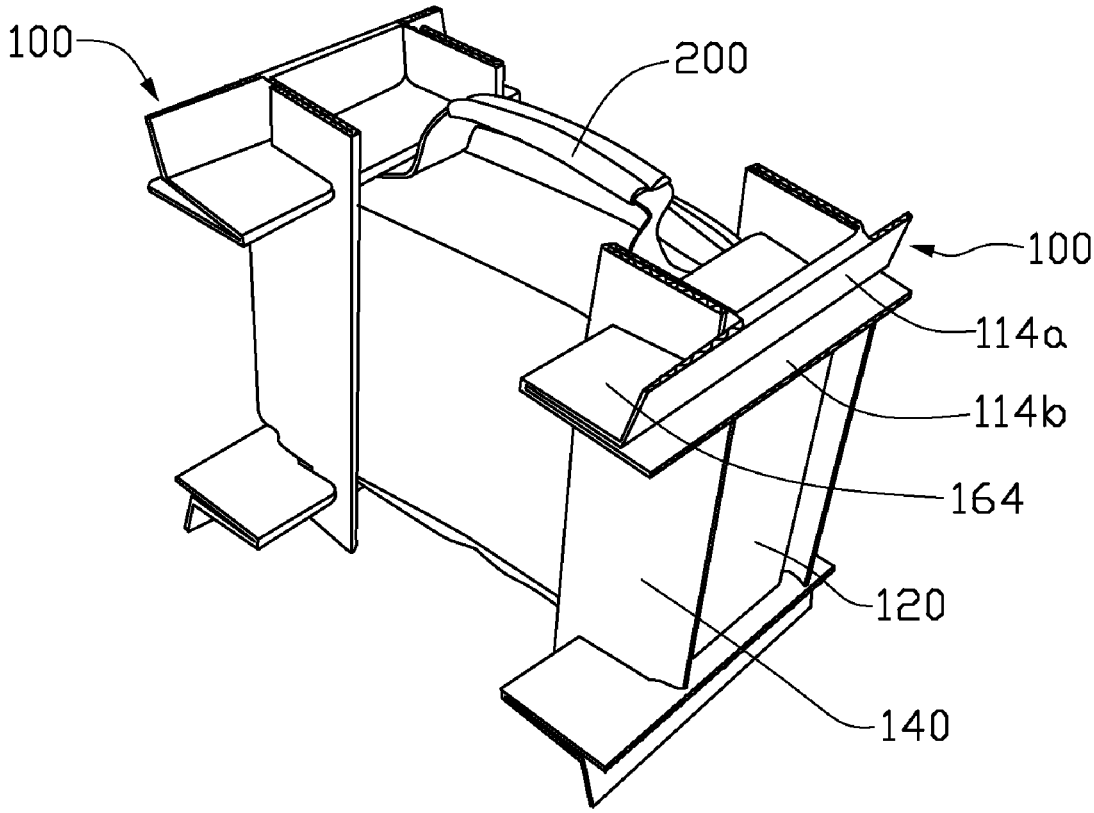
FIG. 6 is an assembled, isometric view of two shock absorbing devices of FIG. 5 and an object.
Figure 7:
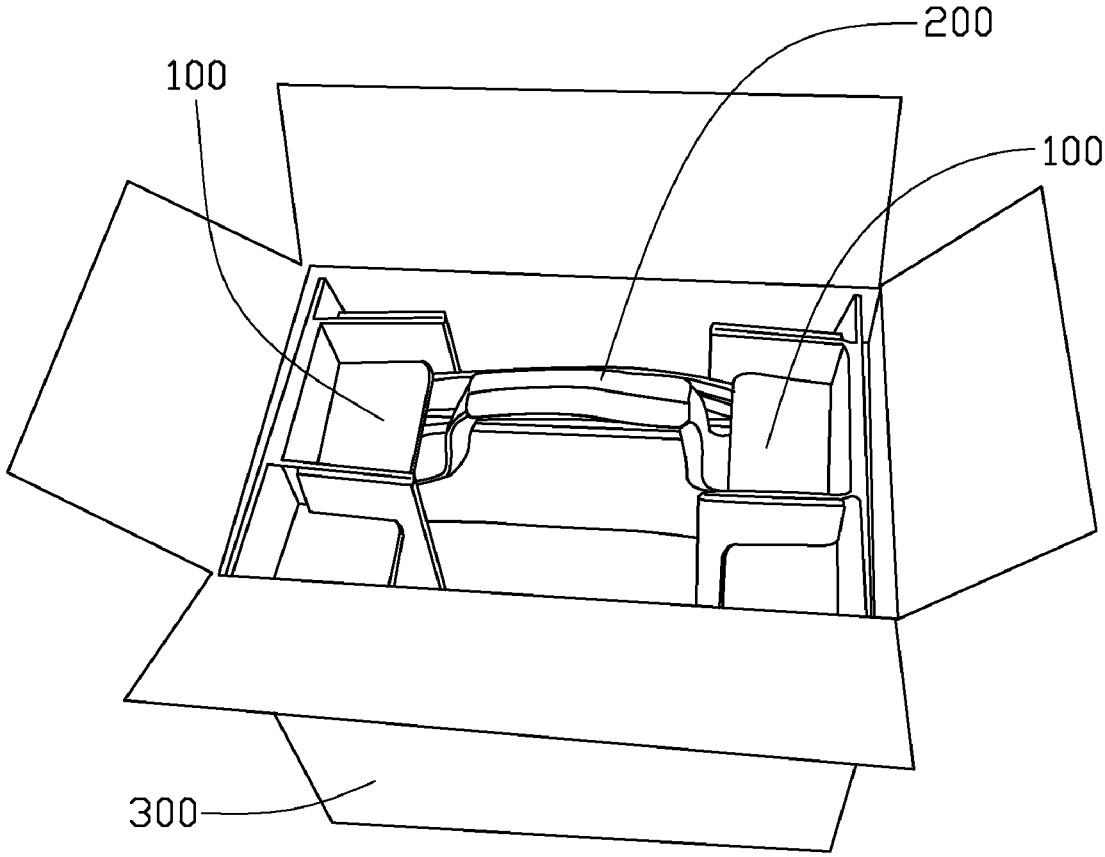
FIG. 7 is similar to FIG. 6, but shows the combination of the shock absorbing devices and the object in a container.

FIGS. 6-7 show an exemplary usage of the shock absorbing device 100. Two shock absorbing devices 100 are employed here to hold opposite portions of an object in spaces 180, such as a notebook bag 200. The shock absorbing devices 100 holding the notebook bag 200 are then placed into a packing container 300, for facility of conveyance and handling.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A shock absorbing device formed by a foldable card board sheet comprising:

a rectangular base portion;

two wings extending perpendicularly from two opposite edges of the base portion; and two flaps extending perpendicularly from another two opposite edges of the base portion;

the wings and the flaps being folded perpendicular to the base portion to enclose a space, wherein two separate slots are defined in the base portion, each wing includes a first sheet extending perpendicularly from an edge of the base portion folded facing the other, the first sheet defines two grooves therein, the slots and the grooves respectively communicate with each other, each flap comprises a connecting flange and a first flange extending from the connecting flange, the connecting flange of the flap is folded parallel to the base portion and the first flange connecting to the connecting flange is folded and inserted into the slots of the base portion and the grooves of the first sheet.

2. The shock absorbing device as claimed in claim 1, wherein each wing further comprises a second sheet extending from the first sheet, the second sheet folded parallel to the first sheet, and wherein each second sheet defines two cutouts therein aligned with the grooves respectively, and the first flanged is inserted in to the slots of the base portion, the grooves of the first sheet and the cutouts of the second sheet.

3. The shock absorbing device as claimed in claim 2, wherein each flap further comprises a second flange extending from the first flange, the second flange is folded parallel to the first flange and inserted into the slots, grooves and the cutouts as the first flange.

4. The shock absorbing device as claimed in claim 3, wherein each flap defines two spaced channels therein, perpendicular to and bisected by the corresponding junction of the first and second flanges, and when the wings are snapped in the channels, the flaps and the wings are interlocked to reinforce the shock absorbing device.

* * * * *